US010933665B2

(12) United States Patent
Lo

(10) Patent No.: US 10,933,665 B2
(45) Date of Patent: Mar. 2, 2021

(54) MODULE TO INCREASE MEDIUM STORAGE CAPACITY

(71) Applicant: Hewlett-Packard Development Company, L.P., Spring, TX (US)

(72) Inventor: Kevin Lo, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/495,716

(22) PCT Filed: Mar. 30, 2017

(86) PCT No.: PCT/US2017/025055

§ 371 (c)(1),
(2) Date: Sep. 19, 2019

(87) PCT Pub. No.: WO2018/182625

PCT Pub. Date: Oct. 4, 2018

(65) Prior Publication Data

US 2020/0094591 A1 Mar. 26, 2020

(51) Int. Cl.

| | |
|---|---|
| ***B41J 13/10*** | (2006.01) |
| ***B65H 1/04*** | (2006.01) |
| ***B65H 1/26*** | (2006.01) |

(52) U.S. Cl.

CPC ..... *B41J 13/103* (2013.01); *B65H 1/04* (2013.01); *B65H 1/266* (2013.01); *B65H 2402/10* (2013.01); *B65H 2405/332* (2013.01)

(58) Field of Classification Search

CPC . B41J 13/103; B41J 13/08; B41J 13/10; B41J 13/106; B41J 11/007; B41J 17/102; B41J 17/02; B65H 1/04; B65H 1/266; B65H 2402/10; B65H 2405/332; B65H 2405/15; B65H 2407/21

See application file for complete search history.

(56) References Cited

U.S. PATENT DOCUMENTS

| | | | | |
|---|---|---|---|---|
| 5,152,520 | A * | 10/1992 | Farrell et al. | B65H 1/266 |
| 5,326,093 | A | 7/1994 | Sollitt | |
| 5,620,269 | A | 4/1997 | Gustafson | |
| 5,820,281 | A | 10/1998 | Hill et al. | |
| 5,975,515 | A * | 11/1999 | Capri et al. | B65H 1/266 |
| 6,688,590 | B2 | 2/2004 | Billings et al. | |
| 7,070,250 | B2 | 7/2006 | Lester et al. | |
| 7,874,665 | B2 | 1/2011 | Silverbrook | |
| 2014/0210921 | A1 | 7/2014 | Lo et al. | |
| 2014/0312556 | A1* | 10/2014 | Nakamura | B65H 1/04 |
| 2015/0210488 | A1 | 7/2015 | Bradford et al. | |
| 2016/0347561 | A1 | 12/2016 | Arakane | |

FOREIGN PATENT DOCUMENTS

| | | | |
|---|---|---|---|
| EP | 0808719 | | 11/1997 |
| EP | 1612051 | | 1/2006 |
| JP | 0392870 | A | 4/1991 |
| JP | 2903410 | | 6/1999 |
| JP | 2001350540 | A | 12/2001 |

* cited by examiner

*Primary Examiner* — Juanita D Jackson
(74) *Attorney, Agent, or Firm* — Fabian VanCott

(57) ABSTRACT

A module, the module including: a first side, a second side, a top, and a bottom; an output port on the first side to feed medium to a side port of an imaging device; a communication port to communicate with the imaging device; and an intake port on the bottom of the module to receive medium from a first medium storage tray.

20 Claims, 7 Drawing Sheets

MODULE TO INCREASE MEDIUM STORAGE CAPACITY

BRIEF DESCRIPTION OF THE DRAWINGS

The accompanying drawings illustrate various examples of the principles described herein and are a part of the specification. The illustrated examples do not limit the scope of the claims.

Figure 1:
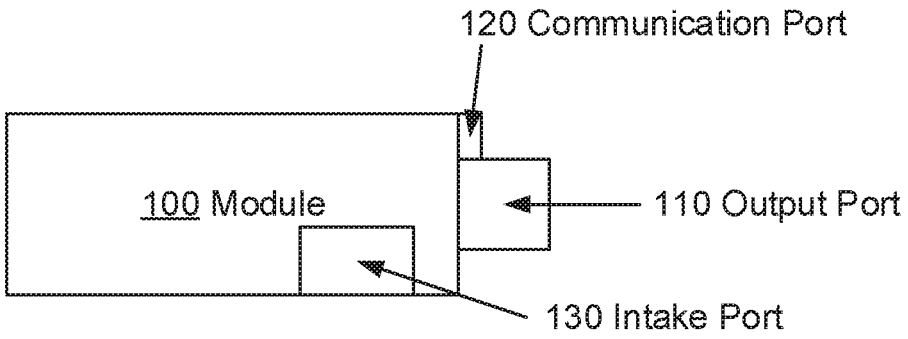
FIG. 1 shows an example of an interface module for connecting a medium storage tray to an imaging device according to one example consistent with the present disclosure.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description: however, the description is not limited to the examples and/or implementations provided in the drawings.

DETAILED DESCRIPTION

Imaging systems currently have a fixed amount of space to store medium underneath the imaging device. Medium storage capacity limits the number of types of medium that are available simultaneously on an imaging system. Medium storage capacity limits the number of printed products that may be produced without restocking the medium supply. In some cases, the medium supply cannot be restocked without pausing operation of the imaging system. Finally, as imaging systems have moved from smaller to larger systems that support greater numbers of users, the imaging system may be located further from the user's work location, reducing users' awareness of the status of medium in the imaging system. Accordingly, users may arrive at an imaging device with the medium exhausted and their job waiting in queue to be processed.

Imaging systems have a fixed amount of space below the imaging device to store media. Increasing the height of the imaging devices impacts safety and usability standards when trying increasing medium storage capacity. See, e.g., IEC 62368-1 Audio/video, information and communication technology equipment—Part 1: Safety requirements, especially the tip/tilt requirements. Accordingly, imaging systems can only be heightened so much to increase medium storage capacity beneath the imaging system.

A cart may be located adjacent to the imaging system. The cart feeds medium into the imaging system to provide additional medium options and additional medium storage capacity. However, many imaging systems were not designed to accommodate carts. In one example, a cart design may be used to retrofit an existing imaging system to increase medium storage capacity.

In order to provide additional capacity to feed medium to the imaging device, a cart needs access to a medium path. In one example, the medium path is accessed through a side feed port. Many imaging devices include a side feed port to support an additional medium type, for example, water-marked paper or other special use medium. However, the side feed port may also be used to accept medium from a cart. This may involve removing a component from the original imaging device and/or adding new components to facilitate reliable interaction with the cart.

Among other examples, this specification describes a module, the module including: a first side, a second side, a top, and a bottom; an output port on the first side to feed medium to a side port of an imaging device; a communication port to communicate with the imaging device; and an intake port on the bottom of the module to receive medium from a first medium storage tray.

This specification also describes an imaging device, the imaging device including: a lower intake port to receive medium from a first medium storage tray located directly below the imaging device; and a side intake port to receive medium from a second medium storage tray located laterally to the imaging device, wherein the first medium storage tray and the second medium storage tray are interchangeable.

This specification also describes an imaging system, the imaging system including: an imaging device; a first medium storage tray located directly beneath the imaging device; an interface module connected to a side port of the imaging device; a second medium storage tray located directly beneath the interface module; and a controller area network (CAN) bus connecting the imaging device and the interface module, wherein the first medium storage tray and the second medium storage tray are interchangeable.

Turning now to the figures, FIG. 1 shows an interface module (100) for connecting a medium storage tray to an imaging device according to one example consistent with the present disclosure. The interface module (100) includes: a first side, a second side, a top, and a bottom; an output port (110) on the first side to feed medium to a side port of the imaging device; a communication port (120) to connect to a bus of the imaging device; and an intake port (130) on the bottom of the module (100) to receive medium from a first medium storage tray.

Modules (100) are used to add additional functionality to an imaging device or imaging system. The use of a module (100) allows economies of scale in the baseline imaging device. A user can then select additional features and modules (100) provide the ability to add those additional features to the baseline imaging device. A module (100) allows a user to achieve the functionality of a higher baseline model for features the user cares about without purchasing all of the features of the higher baseline model.

As shown in FIG. 1, the interface module (100) provides the ability to add additional medium storage trays onto an imaging device or imaging system. The module may be envisioned and designed as part of the design of the imaging device. The module may be designed to allow retrofit of the imaging device and add capabilities not envisioned when an imaging device was designed.

The output port (110) provides medium to a side port of an imaging device or imaging system. Components may be removed from the side port of the imaging device to allow the output port to interact with the imaging device. For example, some imaging devices include a side port that has a paper feeder to allow a small stack of medium to be fed into the side port of the imaging device. Users may place letterhead and/or other special medium into the paper feeder for jobs without adding medium to the medium storage trays.

The output port (110) provides medium passing through the interface module (100) to a side port of the imaging device. In one example, the medium comes from additional medium storage trays located underneath the module (100). The medium may come from additional medium storage trays located above the module (100). The medium may come from a feed located above the module (100), for example, a single page feed. The medium may come from a side feed. The medium may come from a second interface module (100) that is daisy chained to the first interface module (100).

The communication port (120) allows the module (100) to communicate with the imaging device. The side port on imaging devices is used to provide medium under user control. The user assures that the medium and the job are matched. In contrast, when pulling from medium storage trays located, for example, below the imaging device, the imaging device may check information from the medium storage trays and determine suitability of the medium for imaging jobs. This information may include: the presence or absence of medium in a tray, size information on medium in a storage tray, and/or other characteristics of the medium in the storage tray (e.g., color, letterhead, watermark, medium type, paper type, etc.). The ability to have multiple medium storage trays that can be used to selectively feed medium to the imaging device allows a user to process a variety of job types without having to change out medium.

The side port on the imaging device may lack access to this type of information for medium being provided by a user. When adding additional medium storage capacity that provides medium through the output port (110), the communication port (120) allows the interface module (100) to provide this information and selection from the various medium storage options associated with the interface module (100).

In one example, the communication port (120) is attached to a communication bus of the imaging device. This allows the interface module to receive requests from the imaging device and communication information on medium feed to the imaging device. The bus may be a Controller Area Network (CAN) bus. The bus may be a Serial Peripheral Interface (SPI) bus. The bus may be a universal asynchronous receiver/transmitter (UART) bus. The communication port (120) may be connected to a local area network (LAN). The communication port may communication using a physical connection (e.g. a cable and/or fiber optic) and/or wirelessly.

The communication port (120) may communicate indirectly with the imaging device. For example, the imaging device may lack a cable or connection at the side input to interface with the communication port. The communication port (120) may communicate through a local network with the imaging device. The communication port (120) may communicate with the imaging device using a port located away from the side port, for example, a cable may be used to connect the module (100) and the back of the imaging device.

The intake port (130) receives medium from a medium storage tray located beneath the interface module (100). The medium is routed on a medium travel path from the intake port (130) to the output port (110).

In one example, the medium storage tray is a single medium storage tray located beneath the interface module (100). There may be multiple medium storage trays located beneath the interface module (110), each of the multiple medium storage trays providing medium through the intake port (130). The medium storage tray located underneath the interface module (110) may be interchangeable with a medium storage tray located underneath the imaging device. This reduces the number of components that need to be stocked, produces economies of scale, and takes advantage of the other benefits of standardization.

In one example, the bus of the imaging device is a controller area network (CAN) bus. The module may include a controller area network (CAN) bus node (882, FIG. 8).

The module (100) may further include a reservoir to hold imaging fluid. The reservoir may be in fluidic communication with an imaging fluid supply line and/or reservoir in the imaging device. The module (100) may include an access panel that allows imaging fluid to be added to the reservoir. The reservoir may include a level sensor. The reservoir may include an on/off level sensor, for example an electrical continuity sensor using an electrode in the imaging fluid and a second electrode at a depth of the reservoir indicating a notice condition. In one example, the notice condition is a low level indicator to signal a refill of the imaging fluid. The level sensor may include a plurality of electrodes along a depth of the reservoir to provide feedback on the fluid level in the reservoir.

In one example, the reservoir provides a signal when there is sufficient capacity for a standard sized refill to be added. The standard sized refill may be, for example, 1-liter, 2-liters, 1 gallon, etc. In one example, the reservoir includes a cap, similar to a gas cap on an automobile, which covers a wider mouth access to filling the reservoir. The reservoir may include an air vent to allow air to escape while filling.

The module (100) may include multiple reservoirs, for example, reservoirs for multiple types of imaging fluid. In one example, the multiple types of imaging fluid are multiple colors of ink. The multiple types of imaging fluid may include pretreatment and/or post treatment fluid. The multiple types of imaging fluid may include three-dimensional layering fluid.

The module (100) may include a pump to transmit imaging fluid into the imaging device. The module (100) may include a port and/or a supply line to provide fluid to the imaging device.

The module (100) may include mechanical features in the bottom of the module to secure the module (100) on top of the medium storage tray. The module may include recesses and/or protrusions to stabilize and secure the module (100). In one example, the module (100) interlocks with a cabinet and/or framework which hold a plurality of medium storage trays. The number of medium storage trays below the module (100) and the number of medium storage trays below the imaging device may be the same number of trays. For example, the imaging device and the module may both have three trays located beneath the imaging device and the module (100) respectively.

The module (100) may include mechanical features in the top of the module to secure a second medium storage tray on top of the module, wherein the first and second medium storage trays are interchangeable and a port to receive medium from the second medium storage tray. The second medium storage tray above the module (100) may be in a cabinet and/or framework that support the tray. The framework may support a plurality of trays. Because the medium storage tray design used beneath the imaging device and the module (100) is designed to feed upwards to an input port on the module and/or a lower input port on the imaging device, the use of the same design for trays above the module (100) may use more parts than a design with customized trays for above the module (100). However, the benefits of standardization from using the same medium storage tray for both above and below the module (100) may outweigh the cost and reliability of the additional parts.

In one example, the medium from the second medium storage tray is feed upward, like exiting the medium storage trays underneath the imaging device and/or module (100), the medium is then moved across the top of the upper medium storage tray(s) and back down the side opposite the first side. The medium is then passed through a medium travel path used to bring medium from a second module (100-2) that is daisy chained to the first module (100). That path may be relatively flat and straight from one side of the module (100) to the other. That path may include deskewing and/or aligning devices to straighten and/or center medium in the medium path. These features are helpful with the longer medium travel path for medium coming from a second module (100) and/or from medium storage trays above the module (100).

The medium storage trays above the module (100) and below the module (100) may be interchangeable. The medium storage trays below the module (100) and below the imaging device may be interchangeable. The use of interchangeable medium storage trays reduces the inventory. The use of interchangeable medium storage trays allows economies of scale in manufacturing. Interchangeable trays also allow reserve trays filled with special use medium to be slotted into multiple locations.

The module (100) may include a second intake port on a second side to receive feed medium. This allows the same single feed and/or small scale feed provided by the original side port of the imaging system now occupied by the output port (110) of the module (100) to be available when the module (100) is in place. The second intake port on the module may be opposite the output port. In this case, the first side and second side of the module (100) are opposite sides of the module (100). This approach has the advantage of making the medium travel path flat and straight. However, a travel path from the front and/or the back of the module to the output port (110) is also feasible and may fit some locations better due to space limitations for the total width of the system. The medium path may include a turn. The medium path may include a change of direction for the medium. The module (100) may include a side feed that feeds medium in the direction of the medium's width until the medium is in the medium path and then moves the medium in the direction of the medium's length along the medium path.

The module (100) may include a second intake port on the top of the module (100). This second intake port may be used to provide medium into the medium travel path, replacing the functionality lost when the side port of the imaging device being occupied by the output port (110) of the module (100).

In one example, the module (100) interfaces with a second module (100-2), where the second module (100-2) includes an output port (110-2) in a second input port of the first module (100). The second input port of the module (100) being opposite the output port (110) on the module. A communication port (140-2) on the second module (110-2) may be attached to a second communication port of the first module (100). In one example, the second communication port of the first module (100) is located near the second input port of the first module (100) which receives media from the output port (110-2) of the second module (100-2). Additional modules (100) may be daisy chained together to provide a large number of medium storage trays that feed an imaging system.

Figure 2:
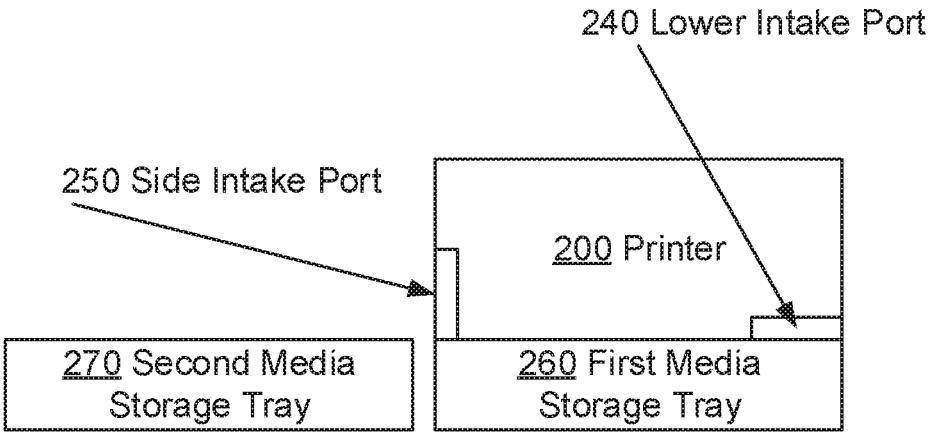
FIG. 2 shows an example of an imaging device consistent with the present disclosure.

With longer medium paths, for example, those associated with multiple modules (100) and/or above the module (100) medium storage trays; it may be advantageous to align and/or deskew the medium during transit. The module (100) may include a medium path between the second intake port on the second side and the output port (110) on the first side includes an alignment system to align and/or straighten medium in the medium path. The module (100) may include a medium path between the second intake port on the second side and the output port (110) on the first side includes a straightening device to straighten medium in the medium path. The module (100) may include both straightening and aligning mechanisms FIG. 2 shows an example of an imaging device (200) consistent with the present disclosure. The imaging device (200) includes: a lower intake port (240) to receive medium from a first medium storage tray (260) located directly below the imaging device (200); and a side intake port (250) to receive medium from a second medium storage tray (270) located laterally to the imaging device (200), wherein the first medium storage tray (260) and the second medium storage tray (270) are interchangeable.

An imaging device (200) is a machine for imaging information on medium. Imaging devices (200) may include a wide variety of ancillary equipment to perform pre and/or post imaging operations. Imaging devices may include, for example: medium storage and handling equipment, finishers, sheet inserters, and other ancillary equipment. Many imaging devices (200) include a scanner and/or similar element to convert information on paper into an electronic format that can be subsequently used for produce copies of the original document.

The lower intake port (240) receives medium from underneath the imaging device (200). The medium may come from a first medium storage tray (260). The medium may come from a plurality of medium storage trays including the first medium storage tray (260). The lower intake port (240) is connected by a medium path to an imaging location in the imaging device (200). The medium is transported to the imaging location, for example, under a printhead, where imaging is applied to the medium.

The side intake port (250) receives medium from a side of the imaging device (200). The medium may come from a second medium storage tray (270). The side intake port (250) may interface with an interface module (100) in order to control the delivery of medium from a second medium storage tray (270) located lateral to the imaging device (200).

The first medium storage tray (260) is located underneath the imaging device (200). The imaging device (200) may rest directly on the first medium storage tray (260). The imaging device (200) may rest on a framework and/or support structure that also supports the first medium storage tray (260). The support structure may house a single medium storage tray (260). The support structure may house a plurality of medium storage trays (260). The plurality of medium storage trays may be interchangeable with each other and with the second medium storage tray (270). The use of interchangeable medium storage trays provides benefits in reducing inventories and increasing flexibility in customization for users.

In one example, the first medium storage tray (260) and the second medium storage tray (270) include an identifier that is communicated to the imaging device (200). Thus, if a tray is removed and replaced in a different slot, the imaging device (200) may automatically recognize this relocation without additional user action. In one example, the identifier is a serial number included on an electronic device. The identifier may be a set of pins and/or outputs that may be patterned to provide an identifier. The identifier may include information about the medium stored in the medium storage tray.

The second medium storage tray (270) is located adjacent to the imaging device (200), that is, lateral to the footprint of the imaging device (200). This contrasts with the first medium storage tray (260) which is within the footprint of the imaging device (200). The second medium storage tray (270) is interchangeable with the first medium storage tray (260). The second medium storage tray (260) increases the stored medium accessible by the imaging device (200). The second medium storage tray (260) may increase the number of types of medium accessible by the imaging device (200). The second medium storage tray (260) may be used to simply increase capacity; reducing the frequency that medium needs to be restocked. Reducing restocking frequency may improve user experience. Reducing restocking frequency may reduce the number of times restocking is performed by a user without experience in restocking the imaging device (200), which may reduce the number of restocking errors.

The second medium storage tray (270) may be located in a storage module that includes a plurality of medium storage trays. The storage module may connect the second medium storage tray (270) and an interface module (100). The all the medium storage trays in the storage module (270) including the second medium storage tray (270) may be interchangeable.

Figure 3:
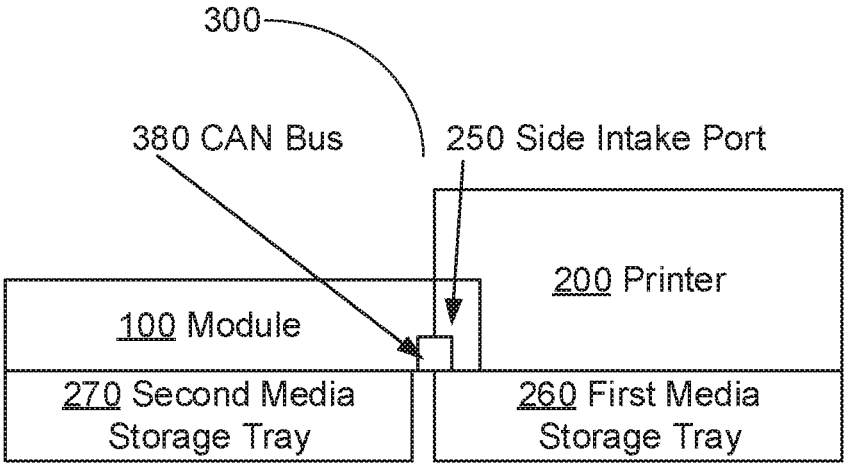
FIG. 3 shows an example of an imaging system consistent with the present disclosure.

FIG. 3 shows an example of an imaging system (300) consistent with the present disclosure. The imaging system (300) includes: an imaging device (200); a first medium storage tray (260) located directly beneath the imaging device (200); an interface module (100) connected to a side intake port (250) of the imaging device (200); a second medium storage tray (270) located directly beneath the interface module (100); and a controller area network (CAN) bus (380) connecting the imaging device (200) and the interface module (100), wherein the first medium storage tray (260) and the second medium storage tray (270) are interchangeable.

An imaging system (300) includes an imagining device (200) and may include ancillary devices to support and augment the imaging device (200). Imaging systems (300) may include medium handling equipment, sorters, finishers, medium storage, and other equipment to perform pre imaging and post imaging operations.

In one example, the imagining system includes a Controller Area Network (CAN) bus (380) to coordinate activities between the various parts of the system. The use of a CAN bus (380) allows different microcontrollers and processors to communicate with each other without a host computer. The use of the CAN bus (380) avoids placing the load of the host on, for example, the imagining device processor. The CAN bus (380) also avoids the need for a separate host processor. Because processors to support the CAN bus (380) may be added as the additional components are added, this architecture may provide more flexibility and robustness compared to using the imaging device (200) processor to carry increasing load as modules (100) are added. The ability to implement a CAN bus (380) on a standard 9-pin cable allows the use of standard ports, reducing costs.

Figure 4:
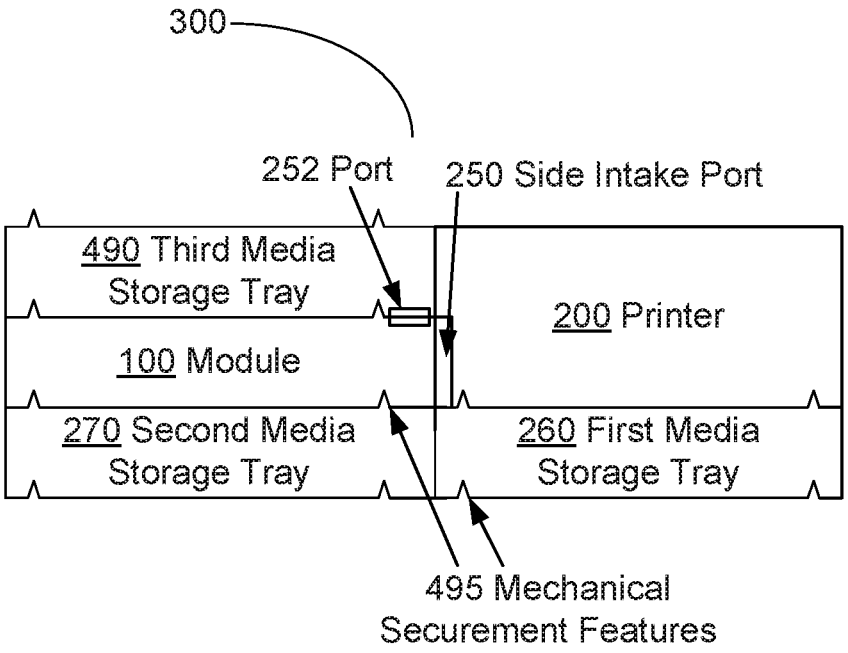
FIG. 4 shows an example of an imaging system consistent with the present disclosure.

FIG. 4 shows an example of an imaging system (300) consistent with the present disclosure. The imaging system (300) includes: an imaging device (200); a first medium storage tray (260) located directly beneath the imaging device (200); an interface module (100) connected to a side intake port (250) of the imaging device (200); a second medium storage tray (270) located directly beneath the interface module (100); a third medium storage tray (490) located directly above the interface module (100), wherein the first medium storage tray (260), the second medium storage tray (270), and the third medium storage tray (490) are interchangeable. Mechanical securement features (495) may be seen between the module (100), the second medium storage tray (270), and the third medium storage tray (490). Mechanical securement features (495) are also located between the first media storage tray (260) and the imaging device (260) located above the first media storage tray (260).

The third medium storage tray (490) is located above the interface module (100). The third medium storage tray (490) may be interchangeable with the other medium storage trays located under the interface module (100) and/or under the imaging device (200). The ability to use the area above the interface module (100) to provide additional medium storage may make effective use of this otherwise unused space.

The third medium storage tray (490) may be in a storage module. The storage module may contain multiple storage trays, including the third medium storage tray (490). The storage module may be interchangeable with a storage module used underneath the interface module (100). The storage module may be interchangeable with a storage module located underneath the imaging device (200). The storage module may provide a portion of an imaging device media path. The storage module may be integrated with the interface module (100). The interface module (100) includes a port (252) to receive media from the bottom of the third medium storage tray (490).

The mechanical securement features (495) may be the same for the various components as shown. This allows flexibility but using standardized features. The mechanical securement features (495) may include protrusions, ridges, bumps, divots, holes, recesses, keyed features, and similar mechanical elements. The use of cones with a rounded tip provides some tolerance and self-guiding when stacking the module (100) on the second medium storage tray (260) and the third medium storage tray (490) on top of the module (100). Self-guiding cones may also be used with the cone downward in to an opening in the device below, in this form the cones may act as legs protecting the module (100) or the medium storage tray from damage.

Figure 5:
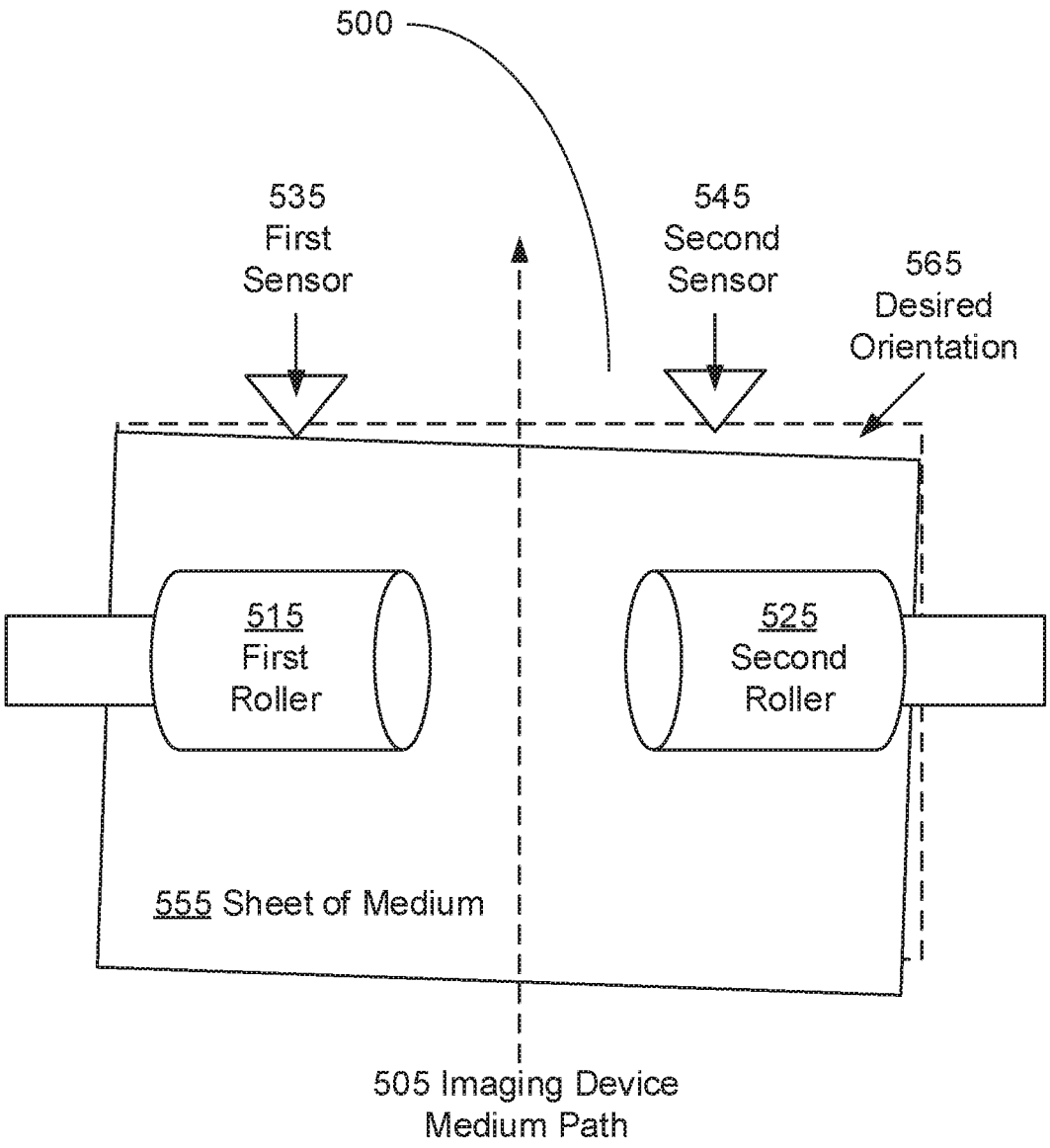
FIG. 5 shows a deskewing system for an imaging device medium path consistent with the present disclosure.

FIG. 5 shows an example of a deskewing system (500) for an imaging device medium path (505) consistent with the present disclosure. The deskewing system (500) includes: a first roller (515); a second roller (525); a first sensor (535); and a second sensor (545). When a sheet of medium (555) enters the deskewing system (500), the first sensor (535) and second sensor (545) detect skew in the sheet of medium (555). Skew is the degree that the orientation of the sheet of medium (555) differs from the desired orientation (565). If skew is detected, the deskewing system (500) rotates the first roller (515) and second roller (525) at different rates to correct the skew and straighten the sheet of medium (555) to the desired orientation (565).

Figure 6:
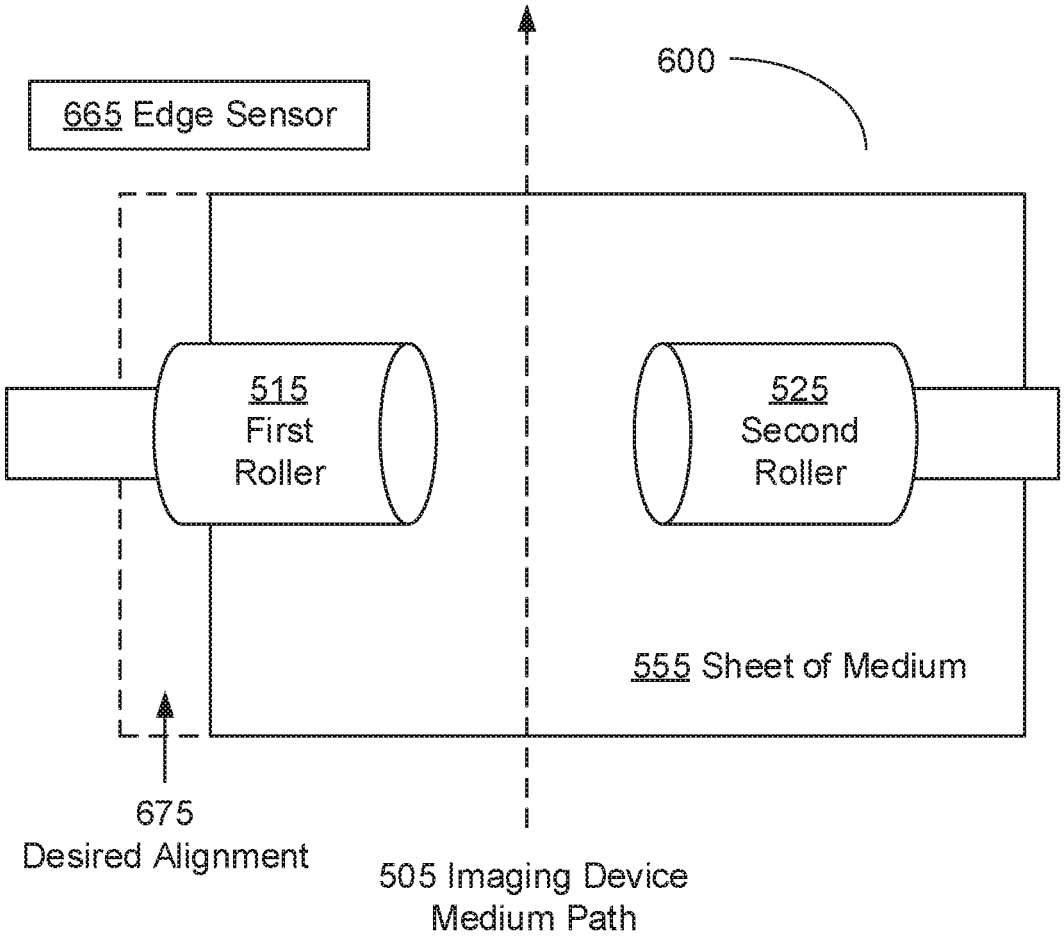
FIG. 6 shows an alignment system for an imaging device medium path consistent with the present disclosure.

FIG. 6 shows an example of an alignment system (600) for an imaging device medium path (505) consistent with the present disclosure. The alignment system (600) includes an edge sensor (665), a first roller (515), and a second roller (525). The alignment system (600) detects the edge of a sheet of medium (555) traveling along the imaging device medium path (505) using the edge sensor (665). The alignment system (600) may then apply differential rotation to the first roller (515) and second roller (525) to "walk" the sheet of medium (505) to the desired alignment (675). In one example, this walking is performed by rotating the second roller (525) more than the first roller (515), advancing both rollers (515, 525) to reposition the sheet of medium (505), and then rotating the first roller (515) more than the second roller (525) to straighten the sheet of medium (505) at the desired alignment (675).

The alignment system (600) may include multiple edge sensors (665). The edge sensor (665) may be located before the rollers (515, 525). The edge sensor (665) may be located after the rollers (515, 525) as shown in FIG. 6. In one example, edge sensors (665) are located both before and after the rollers (515, 525). The use of multiple edge sensors (665) along an edge of a sheet of medium (555) may be used to measure skew. In one example, information from an edge sensor (665) and a first sensor (535) are combined to determine the position and orientation of a sheet of media (555). Multiple edge sensors (665) may be used to determine a travel speed of a sheet of medium (555) along the medium path (505).

A deskewing system (500) and/or an alignment system (600) may be implemented in other manners. For example, an alignment (600) and/or deskewing system (500) could use a roller (515, 525) operating at an angle to the imaging device medium path to advance a sheet of medium (555) along a guide. The guide providing reactive force to conform the edge of the sheet of medium to the target alignment and orientation.

The alignment system (600) and the deskewing system (500) may be used individually and/or together. The module (100) may include just an alignment system (600), just a deskewing system (500), or a combination system that performs both deskewing and alignment.

Figure 7:
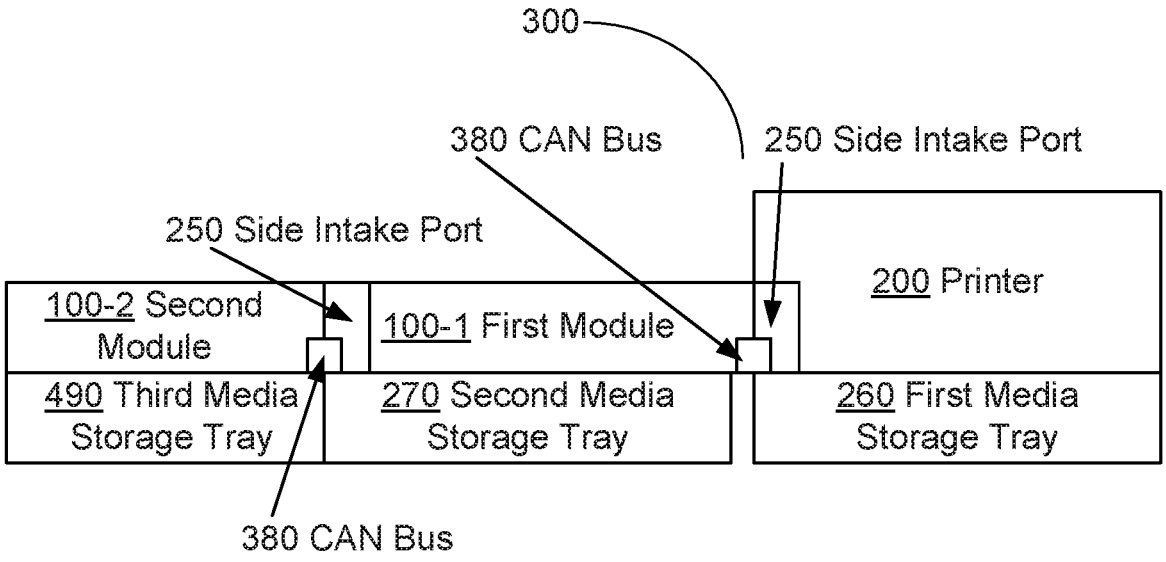
FIG. 7 shows an imaging system consistent with the present disclosure.

FIG. 7 shows an imaging system (300) consistent with the present disclosure. The imaging system (300) includes two modules (100) daisy chained together. Each module (100) sits on a media storage tray (270, 490). The second module (100-2) is connected to a side intake port (250) on the first module (100-1). Media flows from the third media storage tray (490) through the second module (100-2) into the first module (100-1) and then into the printer (200). Similarly, media flows from the second media storage tray (270) into the first module (100-1) and then into the printer (200).

Figure 8:
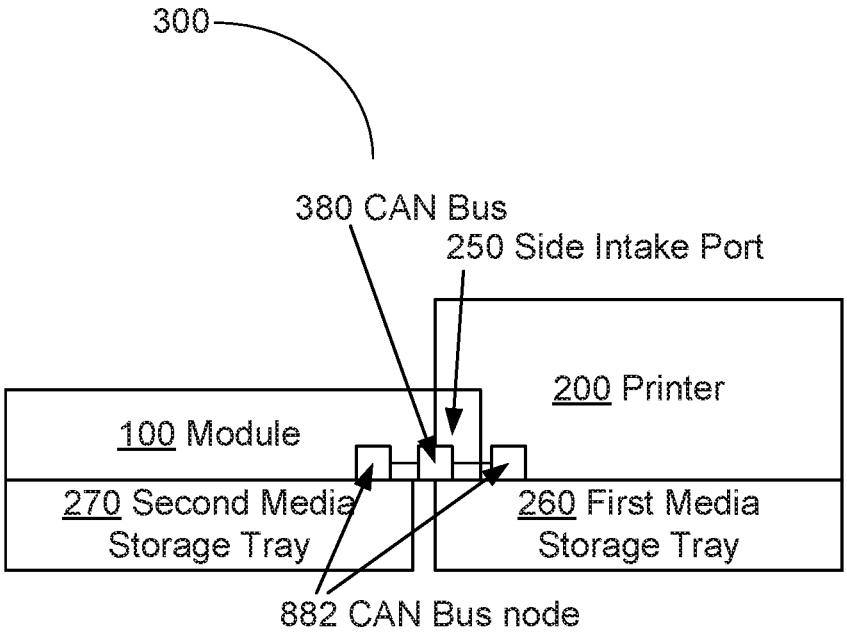
FIG. 8 shows an imaging system consistent with the present disclosure.

FIG. 8 shows an imaging system consistent with the present disclosure. FIG. 8 shows a CAN bus node (882) connected to the CAN bus (380) connecting the module (100) and the printer (200). A second CAN bus node (882) is located in the printer (200).

It will be appreciated that, within the principles described by this specification, a vast number of variations exist. It should also be appreciated that the examples described are only examples, and are not intended to limit the scope, applicability, or construction of the claims in any way.

What is claimed is:

1. A module, the module comprising:

a first side, a second side, a top, and a bottom;

an output port on the first side to feed medium to a side port of an imaging device;

a communication port on the first side to communicate with the imaging device;

a first intake port on the bottom of the module to receive medium from a first medium storage tray; and a second intake port on the top of the module to receive medium from a second medium storage tray.

2. The module of claim 1, wherein the communication port communicates with a controller area network (CAN) bus in the module.

3. The module of claim 2, wherein the module includes a controller area network (CAN) bus node.

4. The module of claim 1, further comprising mechanical features in the bottom of the module to secure the module above the first medium storage tray.

5. The module of claim 4, further comprising mechanical features in the top of the module to secure a second medium storage tray above the module.

6. The module of claim 5, wherein the first and second medium storage trays are interchangeable.

7. The module of claim 1, further comprising a side intake port on the second side of the module to receive medium.

8. The module of claim 7, wherein the first side and the second side are opposite sides of the module.

9. The module of claim 7, further comprising a second communication port to connect to a second module, the second module providing medium to the side intake port on the second side of the module.

10. The module of claim 9, wherein a medium path between the side intake port on the second side of the module and the output port on the first side of the module includes an alignment system to align medium in the medium path.

11. The module of claim 9, wherein a medium path between the side intake port on the second side of the module and the output port on the first side of the module includes a deskewing system to straighten medium in the medium path.

12. An imaging device, the imaging device comprising:

a lower intake port to receive medium from a first medium storage tray located directly below the imaging device; and a side intake port to receive medium from a second medium storage tray located laterally to the imaging device, wherein the first medium storage tray and the second medium storage tray are interchangeable.

13. The imaging device of claim 12, further comprising a communication port at the side intake port such that a controller directing provision of medium to the side intake port from the second medium storage tray to communicate with the imaging device through the communication port.

14. An imaging system, the imaging system comprising:

an imaging device comprising a side port to receive media;

a first medium storage tray located directly beneath the imaging device;

an interface module connected to the side port of the imaging device;

a second medium storage tray located directly beneath the interface module; and a controller area network (CAN) bus connecting the imaging device and the interface module, wherein the CAN bus comprises a first CAN bus node in the interface module and a second CAN bus node in the imaging device, wherein the first medium storage tray and the second medium storage tray are interchangeable.

15. The imaging system of claim 14, wherein the interface module comprises a deskewing system to straighten medium in a medium path.

16. The imaging system of claim 14, wherein the interface module comprises an alignment system to align medium in a medium path.

17. The imaging system of claim 14, further comprising a third medium storage tray located above the interface module.

18. The imaging system of claim 17, wherein the first medium storage tray, second medium storage tray, and third medium storage tray are interchangeable.

19. The imaging system of claim 14, further comprising a second interface module connected to the first interface module.

20. The imaging system of claim 19, further comprising a third medium storage tray located directly underneath the second interface module.

* * * * *